US008087794B2

(12) United States Patent
Stravinskas et al.

(10) Patent No.: US 8,087,794 B2
(45) Date of Patent: Jan. 3, 2012

(54) SELF-ILLUMINATING BOOK WITH MODE-SWITCHABLE PAGE-EMBEDDED LIGHTING

(76) Inventors: Janice Stravinskas, Saugus, MA (US); Joseph V. Stravinskas, Saugus, MA (US); Russ Weinzimmer, Milford, NH (US)

( * ) Notice: Subject to any disclaimer, the term of this patent is extended or adjusted under 35 U.S.C. 154(b) by 82 days.

(21) Appl. No.: 12/322,053

(22) Filed: Apr. 23, 2009

(65) Prior Publication Data

US 2010/0109314 A1 May 6, 2010

Related U.S. Application Data

(60) Provisional application No. 61/198,456, filed on Nov. 6, 2008.

(51) Int. Cl.
*F21V 33/00* (2006.01)

(52) U.S. Cl. ..... 362/98; 362/99

(58) Field of Classification Search ..... 362/98, 362/99

See application file for complete search history.

(56) References Cited

U.S. PATENT DOCUMENTS

| | | | | | |
|---|---|---|---|---|---|
| 3,364,344 | A | | 1/1968 | Marcellino | |
| 3,500,034 | A | | 3/1970 | Bissell | |
| 4,209,824 | A | * | 6/1980 | Kaufman | 362/98 |
| 4,363,081 | A | | 12/1982 | Wilbur | |
| 4,680,681 | A | | 7/1987 | Fisherman et al. | |
| 5,118,138 | A | | 6/1992 | Brotz | |
| 5,167,508 | A | * | 12/1992 | Mc Taggart | 434/317 |
| 5,301,982 | A | | 4/1994 | Brotz | |
| 5,460,414 | A | * | 10/1995 | Sargis | 281/38 |
| 5,597,183 | A | * | 1/1997 | Johnson | 283/83 |
| 5,599,048 | A | | 2/1997 | Schioler | |
| D397,468 | S | | 8/1998 | Zeller | |
| 6,022,119 | A | | 2/2000 | Booty, Jr. | |
| 6,805,459 | B1 | | 10/2004 | Prescott et al. | |
| 6,951,403 | B2 | | 10/2005 | Bennett, Jr. | |
| D518,586 | S | | 4/2006 | Kaufman | |
| 7,163,306 | B1 | | 1/2007 | Major et al. | |
| 7,198,382 | B2 | * | 4/2007 | Donovan | 362/184 |

OTHER PUBLICATIONS http://www.goodreads.com/book/show/29082 Downloaded Apr. 21, 2009 Sam and Gus Light Up the Night! (Bright & Early Playtime Books) Interactive childrens book.

(Continued)

*Primary Examiner* — Anabel Ton

(74) *Attorney, Agent, or Firm* — Russ Weinzimmer; Russ Weinzimmer & Associates PC

(57) ABSTRACT

A book is disclosed with light sources embedded in the pages, thereby providing substantially uniform illumination that eliminates any need for external lighting. Visual interest is increased by providing switchability between a plurality of illumination modes, such as Flicker, Flash, On, and Off, each mode causing all of the light sources in at least one page to behave in a substantially identical manner. The light sources can be LED lights embedded in a regular array within translucent sheets that improve the illumination uniformity. An illumination control, on/off switch, and/or power source such as exchangeable or rechargeable batteries can be included in the spine of the book, or in a separate housing in wired communication with the book. Illumination modes can be switched by moving a magnetic and/or conductive portion of a wand near sensors in the pages. Indicia can be printed directly on the translucent sheets, and/or on overlay sheets.

16 Claims, 6 Drawing Sheets

OTHER PUBLICATIONS http://www.amazon.com/Little-Twinkly-8tars-Light-Books/dp/1405486341 Downloaded Apr. 21, 2009 Six Little Twinkly Stars (Light Up Books) Light-up childrens book.

http://www.amazon.com/Ten-Friendly-Fireflies-Light-up-Counting/dp/1581175612 Downloaded Apr. 21, 2009 Ten Friendly Fireflies: A Light-up Counting Book Light-up childrens book.

http://www.theledlight.com/lightwedge.html Downloaded Apr. 21, 2009 Lightwedge LED book lights Imagine a pane of bright, even light illuminating only the page you are reading. That's the idea behind LightWedge•. No glare, no stray light to disturb others. Just rest it on the page and read.

* cited by examiner

SELF-ILLUMINATING BOOK WITH MODE-SWITCHABLE PAGE-EMBEDDED LIGHTING

CROSS-REFERENCES TO RELATED APPLICATIONS

This application is entitled to the benefit of US Provisional Patent Application No. 61/198,456 entitled "LIGHT UP THE NIGHT CHILDREN'S BOOK," filed Nov. 6, 2008, herein incorporated by reference.

FIELD OF THE INVENTION

The invention generally relates to illuminated books, and more specifically to books that include self-illuminating pages.

BACKGROUND OF THE INVENTION

Reading books can be enjoyable and informative. In particular, reading a book to a child can be a pleasant way to spend time with the child, while at the same time calming the child and helping the child to mentally prepare for sleep.

However, light is required so as to read a book, and having a bright light on in a child's room is generally not conducive to mentally preparing the child for sleep. Also, having a light on in a child's room can tend to distract the child, by allowing the child's gaze to wander to various objects in the room, thereby making it more difficult for the child to concentrate on the story being read from the book.

One approach is to darken the room and illuminate the book using only a highly focused light source, such as a light source clipped or otherwise directly attached to the book. However, a highly focused light source can become hot, and can pose a danger to the book, the reader, and/or the child. Also, a highly focused light source can create harsh shadows and other visual effects within the room that a child might find distracting, disturbing, or even threatening.

Some approaches attempt to minimize distraction in a lighted room by including sources of illumination in the book itself, thereby adding visual interest to the book and helping to hold the child's attention. Typically, individual sources of light are positioned at strategic locations within illustrations included on the pages, thereby enabling starts to twinkle, fireflies to blink, and such like. The light sources can be phosphorescent indicia, LED lights, optical fibers, and electro-luminescent lights, among others. Some of these approaches enable a user to interactively control the illumination, for example by pressing switches embedded in the pages. While these approaches can help to avoid distraction by adding visual interest to the book, they do not provide a general, uniform illumination of the pages in the book that would eliminate the need for external lighting.

Other approaches attempt to avoid external lighting by embedding one or more sources of light within the book that provide full-page illumination. For example, some approaches include a lamp embedded at one corner of the book or in the spine, and positioned so as to shine light across the pages as they are read. However, these approaches do not provide uniform illumination of the pages. Another approach uses electroluminescent sheets embedded in the pages to provide uniform, back-lit illumination. However, electroluminescent light sources have a finite lifetime, and fade in intensity with age. In general, while these approaches provide illumination for reading, and thereby eliminate the need for external lighting, they do little if anything to enhance the visual interest of the book.

SUMMARY OF THE INVENTION

A self-illuminating book with embedded lighting is claimed that provides substantially uniform page illumination, enabling the book to be read without external lighting, while at the same time allowing a user to vary the behavior of the lighting, so as to increase the visual interest of the book.

At least some of the pages in the book contain imbedded light sources that provide substantially uniform back-lighting of the pages with a light intensity that allows the pages to be read without external lighting. Note that the term "pages" is used generically herein to refer to both the internal pages and to the front and back covers of the book. The book further includes an illumination controller that is in communication with the light sources, the controller being switchable between a plurality of illumination modes, each illumination mode causing all of the light sources in at least one page to behave in a substantially identical manner. The illumination mode switching capability thereby increases the visual interest of the book, and allows a user to interact with the book, while maintaining uniform illumination of the pages so that they remain readable without external lighting.

In some preferred embodiments, mode switching is controlled by a switch included in the book, preferably in the spine of the book. In other embodiments mode switching is controlled by a separate mode switching control that is in wired communication with the book. In still other embodiments, a mode control wand is included that causes the illumination mode to switch when a control portion of the mode control wand is moved close to a wand sensor included in the book. In preferred embodiments, the control portion of the mode control wand is magnetic, and is sensed by a magnetically controlled reed switch included in the book. In other embodiments, the control portion of the wand is an electrical conductor, preferably made of metal, that controls the illumination mode by being remotely sensed by a capacitive or inductive sensor included in the book. In certain preferred embodiments, a plurality of wand sensors is included in the pages of the book, so as to allow separate control of the illumination modes of individual pages, or even individual sides of pages.

In preferred embodiments, the light sources are LED lights embedded in regular arrays within translucent sheets. Due to the high energy efficiency of the LED lights, they do not become noticeably warm, even when emitting a bright light. The translucent sheets diffuse the light, and improve the uniformity of the illumination. In some embodiments, the illumination modes include one or more of Flicker, Flash, Strobe, Oscillate, Lightening, Blink, On, and Off. Various embodiments also include at least one adjustable control that controls the intensity and/or the rate of variation of the illumination. Power is supplied to the light sources by a power source, which in preferred embodiments is included in the spine of the book, included in the pages, or housed together with the illumination controller in a separate illumination controller housing that is in wired communication with the book. And in some embodiments, an on/of switch is included in the spine of the book.

In certain preferred embodiments, illustrations, writing, and other indicia are printed or otherwise imposed directly on the translucent sheets. In other embodiments, the indicia are imposed on overlay sheets that overlay the translucent sheets.

BRIEF DESCRIPTION OF THE DRAWINGS

The invention will be more fully understood by reference to the detailed description, in conjunction with the following figures, wherein.

DETAILED DESCRIPTION OF PREFERRED EMBODIMENTS

Figure 1:
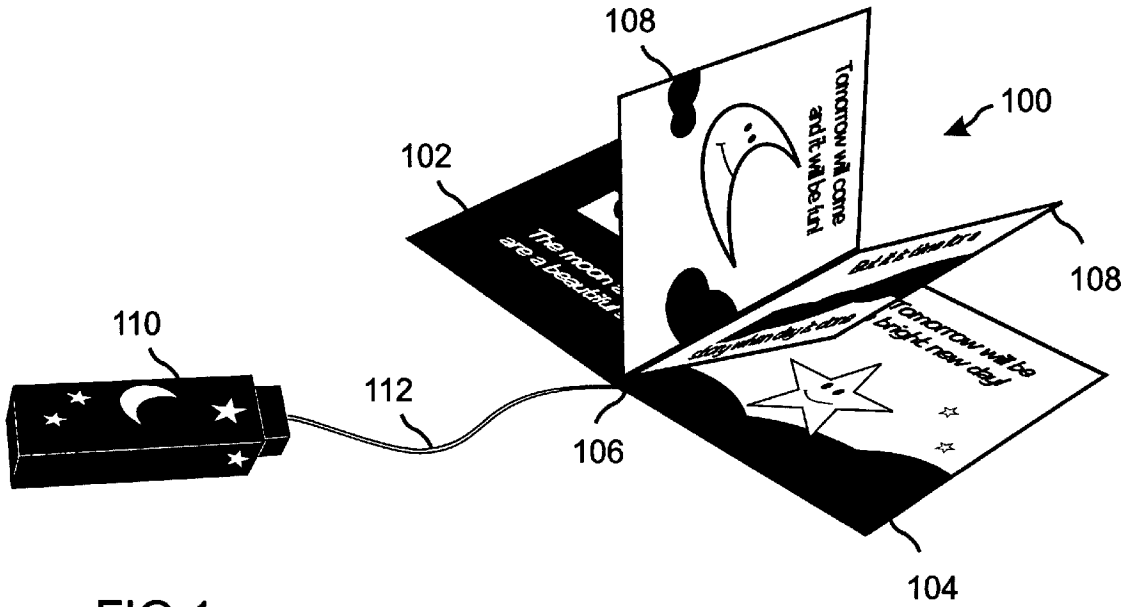
FIG. 1 is a perspective view of an embodiment in which the illumination controller is contained in an illumination controller housing.

With reference to FIG. 1, the present invention is a book 100 with a front cover 102, a back cover 104, a spine 106, and pages 108. The pages include embedded illumination that provides substantially uniform, back-lit illumination of the pages 108 with sufficient intensity to allow the pages 108 to be read without external illumination.

An illumination controller 110 communicates with the book 100 through wires 112, and is able to switch the illumination between a plurality of illumination modes, wherein for each illumination mode the light sources behave in a substantially identical manner. A power source (not shown) is also included. In preferred embodiments, the power source includes batteries that can be exchangeable and/or rechargeable. In the embodiment of FIG. 1, the illumination controller 110 is located in a separate illumination controller housing 110. In some embodiments, the power source is also located within the illumination controller housing 110. In other embodiments, the power source and/or the illumination controller 110 are located within the spine 106.

Figure 2A:
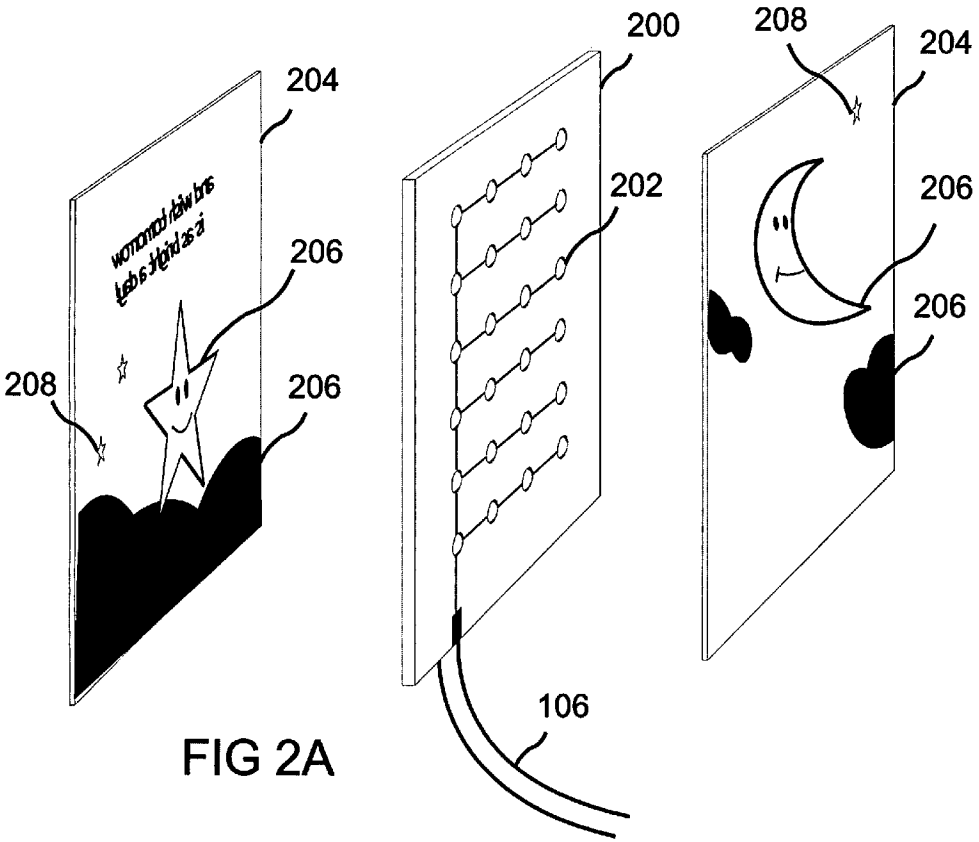
FIG. 2A is a perspective, exploded view of a preferred embodiment page in which LED lights are embedded within a translucent sheet in a uniform array, and indicia are imposed on overlay sheets.

FIG. 2A is a perspective, exploded view of a page of the embodiment of FIG. 1. Each page includes a translucent sheet 200 in which a plurality of LED lights 202 is embedded in a regularly spaced array. In the embodiment of FIG. 2A, the translucent sheet 200 diffuses the light from the LED lights, thereby enhancing the uniformity of the page illumination. In some embodiments, indicia are printed or otherwise applied directly to the translucent sheet 200. In the embodiment of FIG. 2A, indicia are applied to overlay sheets 204 that are attached to the translucent sheet 200 and are back-lit by the LED lights 202. In the illustrated embodiment, the indicia 206 are printed onto the overlay sheets 204, while in other embodiments the indicia 208 are printed directly on the pages 200.

Figure 2B:
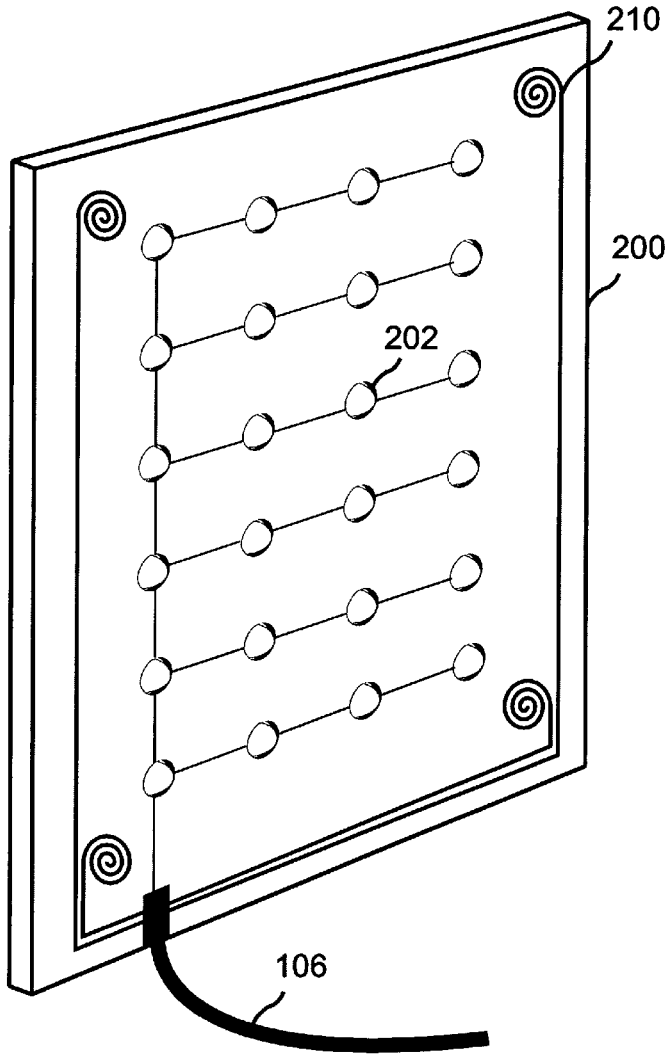
FIG. 2B is a perspective view of a preferred embodiments translucent sheet that includes inductive wand sensors.

FIG. 2B is a perspective view of a translucent sheet 200 similar to the translucent sheet 200 of FIG. 2A, but including inductive wand sensors 210 in the corners. The wand sensors 210 are spiral wire coils that are easily contained within the thickness of the translucent sheet 200. The spiral wire coils 210 are connected to an induction-sensing electronic circuit (not shown) included in illumination controller 110, which in the embodiment of FIG. 2B is included in the spine of the book. The induction-sensing circuit is sensitive to the inductance of the coils 210, so that when an electrically conductive control portion 402 of a mode control want 400 (see the discussion in FIG. 4 below) is brought close to a spiral coil 210, the resulting change in the inductance of the coil 210 is sensed by the electronic circuit, thereby causing the illumination controller 110 to switch modes. In similar embodiments, the control portion 402 of the mode control wand 400 is magnetic, and is sensed by a magnetically sensitive element such as a magnetically activated reed switch.

Figure 3A:
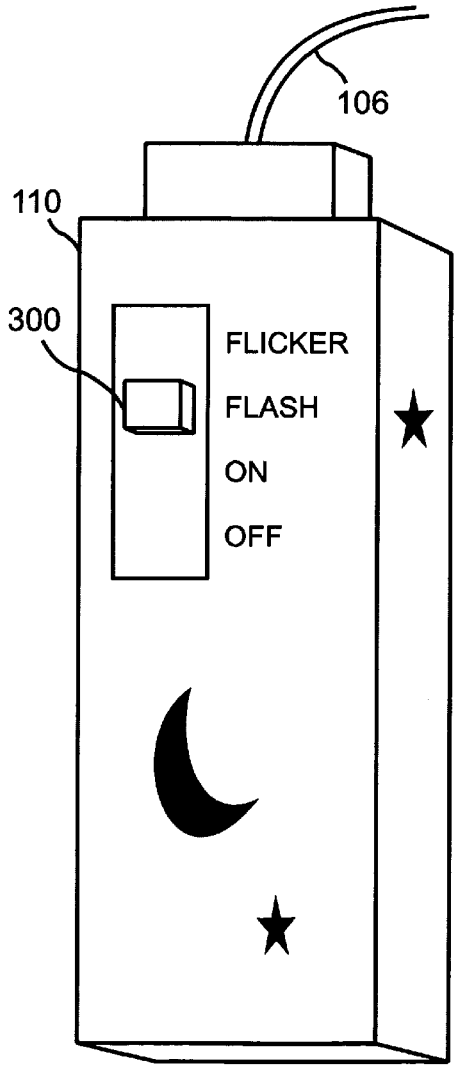
FIG. 3A is a perspective view of an illumination controller housing that enables switching of the illumination controller between Flicker, Flash, On, and Off modes.

FIG. 3A is a close-up perspective view of a preferred embodiment illumination controller housing 110. In the embodiment of FIG. 3A, the illumination controller housing 110 includes a switch 300 that enables the illumination controller to be switched between four modes: Flicker, Flash, On, and Off. The Flicker mode causes the intensity of all of the LED lights 202 to vary simultaneously in a substantially random manner. The Flash mode causes all of the LED lights 202 to simultaneously flash at a steady rate. The On mode causes all of the LED lights 202 to remain on, and the Off mode switches all of the LED lights off. In similar embodiments, the illumination controller 110 includes an intensity control that is used to control the overall intensity of the LED lights 202. In still other embodiments, the illumination controller 110 includes only illumination modes, while a separate on/off control is included in the spine 106 of the book 100. In various embodiments, the control that controls the illumination controller and/or the separate on/off control can be a sliding switch, a toggle switch, a button, a knob, or any other control known in the art.

Figure 3B:
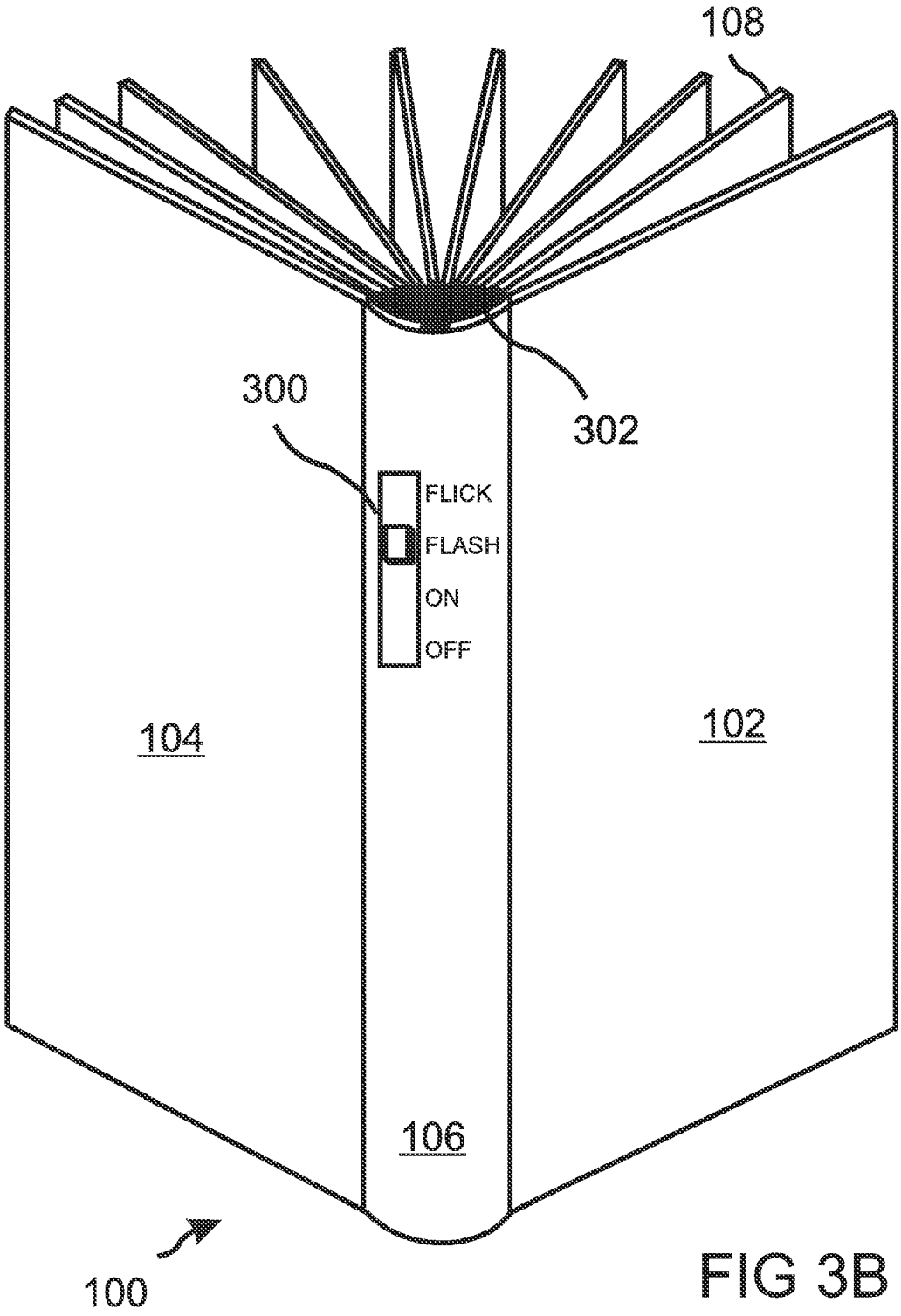
FIG. 3B is a perspective rear view of an embodiment in which the spine contains a power source battery, the illumination controller, and a sliding switch that controls the illumination controller.

FIG. 3B is a perspective view from the rear of an embodiment in which the illumination controller 110 is located within the spine 106, and is controlled by a sliding switch 300 on the spine 106. In this embodiment, the power source is a triple-A battery, also included in the spine 106 and accessible for replacement through a cap 302 on the top of the spine.

Figure 4:
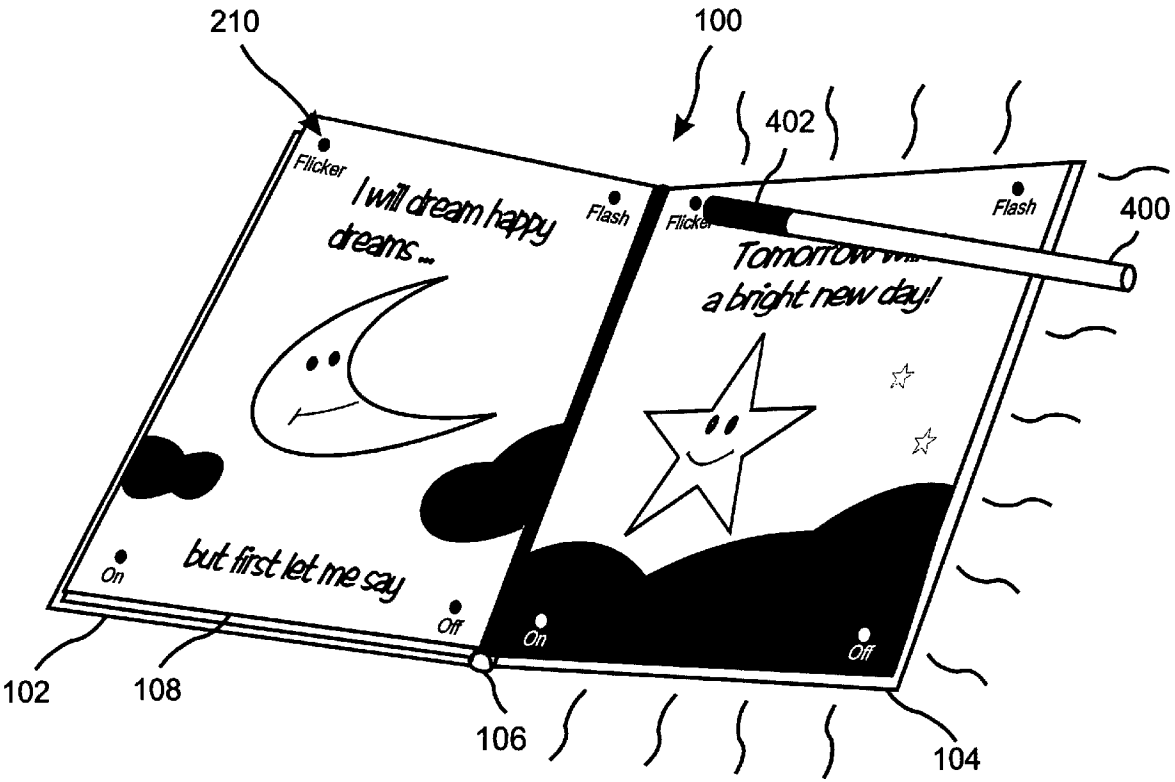
FIG. 4 is a perspective view illustrating use of a mode control wand in a preferred embodiment.

FIG. 4 is a perspective illustration that shows a mode control wand 400 being used to control the illumination mode of the illumination controller 110. In the embodiment of FIG. 4, the wand sensors 210 are spiral coils that are located at each of the corners of each of the pages 108, and correspond to four illumination modes that cause all of the light sources in a selected page to flicker, flash, remain on, or remain off. In the embodiment of FIG. 4, each surface of each of the pages includes a set of wand sensors 210, and the mode control wand 400 includes a control portion 402 that is metallic, and therefore electrically conductive. In some embodiments, the entire wand is conductive, for example the entire wand is a metal rod, and therefore the entire wand is the control portion. When the control portion of the wand is brought close to a wand sensor coil 210, the inductance of the coil 210 changes. The change is sensed by an inductance-sensitive circuit in the illumination controller 110, and the mode of the illumination controller 110 is switched accordingly.

In the embodiment of FIG. 4, each of the interior pages includes two layers of LED lamps separated by an opaque layer, and the illumination mode of each readable surface of each page is separately controlled by the mode control wand. In similar embodiments, each interior page includes only one layer of LED lamps, and the illumination mode of an entire page, or of the entire book, is simultaneously switched by the mode control wand.

Other modifications and implementations will occur to those skilled in the art without departing from the spirit and the scope of the invention as claimed. Accordingly, the above description is not intended to limit the invention except as indicated in the following claims.

What is claimed is:

1. A book having pages with flexibly controlled, embedded illumination, the book comprising:

a spine, a front cover page, a back cover page, and at least one interior page, at least one of the pages including at least one light source embedded therein, the light source being able to provide substantially uniform illumination from within the page with sufficient intensity to enable the page to be read without external illumination;

a power source connected to the at least one light source and able to provide illuminating power thereto; and an illumination controller in communication with the power source, the illumination controller being switchable among a plurality of illumination modes, each illumination mode causing all of the light sources in at least one of the pages to behave in a substantially identical manner, the illumination controller including a mode control wand having a control portion, the control portion being remotely cooperative with at least one wand sensor located within one of the pages so as to cause the illumination controller to switch illumination modes.

2. The book of claim 1, wherein at least some of the light sources are LED lights.

3. The book of claim 2, wherein the LED lights in at least one of the pages are arranged in a uniformly spaced array.

4. The book of claim 1, wherein the light sources are embedded in a translucent sheet that is able to diffuse the illumination provided by the light sources so as to enhance the uniformity of the illumination from within the page.

5. The book of claim 1, wherein the spine contains at least one of:

the power source;

the illumination controller;

a control that controls the illumination controller; and a control that is able to disconnect the power source from the light sources.

6. The book of claim 1, further comprising at least one continuously adjustable control that is able to control one quality of the illumination from within the page.

7. The book of claim 6, wherein the quality of the illumination from within the page is one of:

intensity of the illumination from within the page;

rate of variation of the illumination from within the page; and shape of a waveform controlling a modulation of the illumination from within the page.

8. The book of claim 1, wherein the power source includes at least one battery.

9. The book of claim 8, wherein the batteries are at least one of replaceable and rechargeable.

10. The book of claim 1, wherein the illumination controller is switchable to an illumination mode that is able to cause the light sources to at least one of:

flash;

flicker;

strobe;

oscillate;

blink;

emulate natural lightening;

remain steadily on; and remain off.

11. The book of claim 1, wherein the control portion of the mode control wand is magnetic.

12. The book of claim 11, wherein the wand sensor includes a magnetically activated switch.

13. The book of claim 1, wherein the control portion of the mode control wand is electrically conductive.

14. The book of claim 13, wherein the wand sensor includes an electronic component that is sensitive to nearby electrical conductors, the electronic component being one of a capacitor and an inductor.

15. The book of claim 1, wherein indicia are imposed directly on the pages.

16. The book of claim 1, further comprising overlay sheets attached to the pages, at least some portions of the overlay sheets being at least translucent, the overlay sheets including indicia imposed thereon.

* * * * *